US007568278B2

(12) United States Patent
Han

(10) Patent No.: US 7,568,278 B2
(45) Date of Patent: Aug. 4, 2009

(54) METHOD OF MANUFACTURING INDUCTOR

(75) Inventor: Jae-Won Han, Suwon-si (KR)

(73) Assignee: Dongbu Hitek Co., Ltd., Seoul (KR)

( * ) Notice: Subject to any disclaimer, the term of this patent is extended or adjusted under 35 U.S.C. 154(b) by 0 days.

(21) Appl. No.: 11/896,663

(22) Filed: Sep. 5, 2007

(65) Prior Publication Data

US 2008/0060185 A1 Mar. 13, 2008

(30) Foreign Application Priority Data

Sep. 13, 2006 (KR) ..... 10-2006-0088426

(51) Int. Cl.
*H01F 3/00* (2006.01)
*H01F 41/02* (2006.01)

(52) U.S. Cl. ..... 29/604; 29/602.1; 29/847; 29/852; 216/62; 216/65; 216/66; 336/110; 336/175; 336/178; 336/184; 336/214; 363/17; 363/48; 363/58

(58) Field of Classification Search ..... 29/602.1, 29/604, 847, 852; 336/110, 175, 178, 184, 336/214, 215, 234; 363/17, 48, 58; 216/62, 216/66, 67; 451/5, 41
See application file for complete search history.

(56) References Cited

U.S. PATENT DOCUMENTS

| | | | | |
|---|---|---|---|---|
| 5,756,395 | A * | 5/1998 | Rostoker et al. | 438/622 |
| 6,781,224 | B2 * | 8/2004 | Yoneda et al. | 257/686 |
| 2005/0221601 | A1 * | 10/2005 | Kawano | 438/622 |
| 2007/0155152 | A1 * | 7/2007 | Kang | 438/597 |
| 2007/0246816 | A1 * | 10/2007 | Tajika et al. | 257/686 |

* cited by examiner

*Primary Examiner*—Paul D Kim
(74) *Attorney, Agent, or Firm*—Finnegan, Henderson, Farabow, Garrett & Dunner L.L.P.

(57) ABSTRACT

A method for manufacturing an inductor using a system-in-package (SIP) includes forming a first penetration electrode in a silicon substrate; depositing an insulating film on a first surface of the silicon substrate, and patterning the insulating film to form an inductor hole and a second penetration hole aligned with the first penetration hole; forming an inductor in the inductor hole and a second penetration electrode in the second penetration hole; and depositing a protective film on the insulating film and performing a back grind process such that the first penetration electrode is exposed from a second surface of the silicon substrate, the second surface being opposed to the first surface.

6 Claims, 3 Drawing Sheets

METHOD OF MANUFACTURING INDUCTOR

RELATED APPLICATIONS

This application claims the benefit of priority to Korean Patent Application No. 10-2006-0088426, filed on Sep. 13, 2006, the entire contents of which are incorporated herein by reference.

BACKGROUND

1. Technical Field

The present invention relates to a method of manufacturing a semiconductor device and, more particularly, to a method of manufacturing an inductor using a system-in-package (SIP).

2. Related Art

A semiconductor device, such as a radio frequency (RF) device, may include a plurality of circuit elements, such as a transistor, an inductor, a capacitor, a resistor, and a varactor. Among them, the inductor may be considered as being necessary in an RF chip.

The inductor, as a single device, often occupies the largest area in the RF chip. Because the RF chip should be highly integrated with the circuit elements, the area occupied by the inductor needs be minimized, while maintaining the inductance value of the inductor.

In a passive circuit element, such as the inductor, a characteristic coefficient (Q) and a self-resonant frequency (fωo), which are the main characteristic factors of the inductor, decrease due to an undesired parasitic resistance and an undesired parasitic capacitance. Accordingly, the characteristics of the passive circuit element may deteriorate when applied to an RF integrated circuit (IC).

In order to prevent the main characteristic factors of the inductor from decreasing, it is important to reduce the parasitic resistance and the parasitic capacitance. Accordingly, when the inductor is manufactured, the parasitic resistance and the parasitic capacitance can decrease by forming a metal wiring using a metal of low resistance (e.g., gold (Au)), increasing the thickness of the metal wiring, or increasing the thickness of a dielectric film.

However, in a conventional semiconductor device manufacturing process, it is difficult to prevent the above situation, because a metal film is formed with a large thickness when manufacturing the inductor. In particular, because a transistor and a metal wiring are also formed on a substrate on which the inductor is formed, a process condition is complicated. In addition, when the inductor is erroneously formed, other elements formed on the substrate cannot be used.

When there is a current flowing in the inductor, a magnetic field is induced. The magnetic field may influence the current flowing in the metal wiring located below the inductor. Because the inductor may also serve as a resistor, there is thus a huge influence on the performance of the semiconductor device due to the existence of the induced magnetic field.

SUMMARY

Accordingly, the present invention is directed to a method of manufacturing an inductor that substantially obviates one or more problems due to limitations and disadvantages of the related art.

In one aspect, there is provided a method of manufacturing an inductor, which is capable of independently manufacturing the inductor and a transistor, and connecting the inductor to the transistor via an SIP.

Additional features consistent with the invention will be set forth in the following descriptions and become apparent to those having ordinary skill in the art upon examination of the following or from practice of the invention. The features of the invention may be realized and attained by the structure particularly pointed out in the written description as well as the appended claims and drawings.

Consistent with the present invention, there is provided a method for manufacturing an inductor using a system-in-package (SIP), the method comprising: patterning a silicon substrate to form a first penetration hole, depositing a first barrier metal in an inner wall of the first penetration hole, burying a first metal material in the penetration hole, and planarizing the metal material to form a first penetration electrode; depositing an insulating film on a first surface of the silicon substrate including the first penetration electrode, and patterning the insulating film to form an inductor hole and a second penetration hole aligned with the first penetration hole; depositing a second barrier metal in inner walls of the inductor hole and the second penetration hole, burying a second metal material in the inductor hole and the second penetration hole, and planarizing the second metal material to form an inductor and a second penetration electrode; and depositing a protective film on the insulating film and performing a back grind process such that the first penetration electrode is exposed from a second surface of the silicon substrate, the second surface being opposed to the first surface.

It is to be understood that both the foregoing general descriptions and the following detailed descriptions are exemplary and explanatory, and are intended solely to provide explanations of the claimed invention.

BRIEF DESCRIPTION OF THE DRAWINGS

The accompanying drawings, which are included to provide a better understanding of the invention and are incorporated herein as a part of this application, illustrate embodiment(s) consistent with the invention and, together with the detailed description, serve to explain the principles of the invention.

DETAILED DESCRIPTION

Figure 1A:
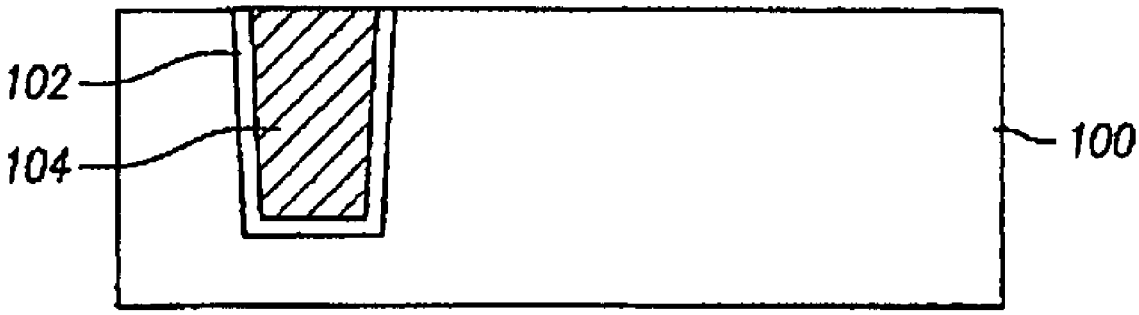
FIGS. 1A to 1C are cross-sectional views illustrating a method of manufacturing an inductor using an SIP, according to an exemplary embodiment consistent with the present invention.

Hereinafter, preferred embodiments consistent with the present invention will be described in detail with reference to FIGS. 1A to 1C. Wherever possible, the same reference numerals will be used throughout the drawings to refer to the same or like features.

The configuration and operation of various embodiments consistent with the present invention will be described with reference to FIGS. 1A to 1C. The configuration and operation shown in FIGS. 1A to 1C and described hereinafter will be described in at least one embodiment, without limiting the spirit and scope of the present invention.

Figure 1B:
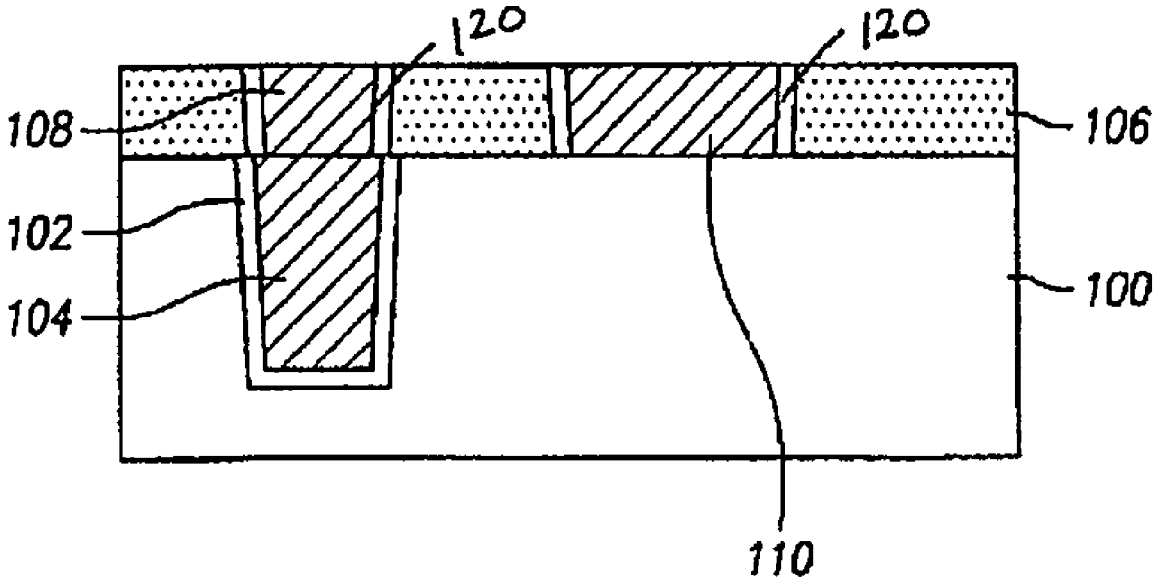
Figure 1C:
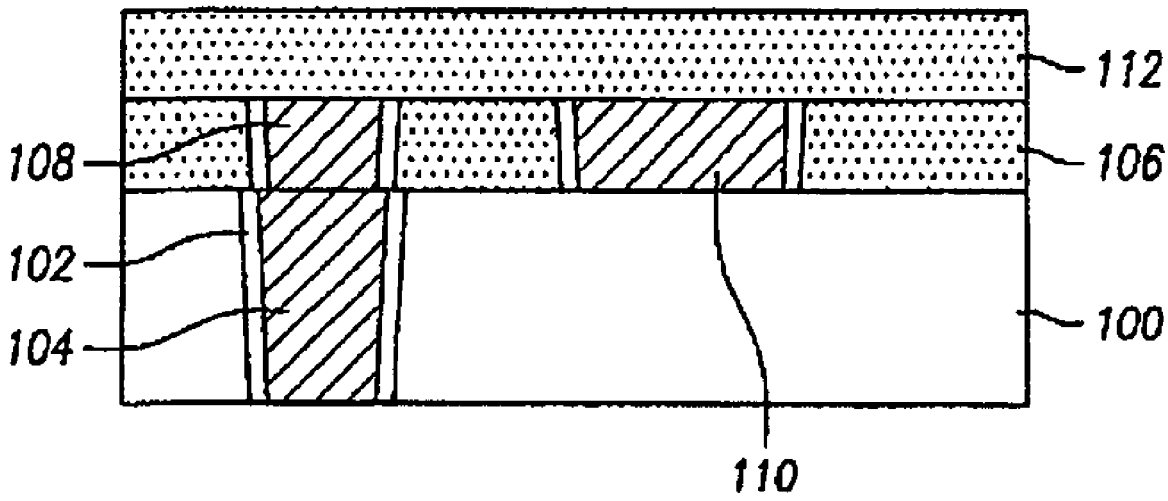

FIGS. 1A to 1C are cross-sectional views illustrating a method of manufacturing an inductor using an SIP, according to an embodiment consistent with the present invention.

As shown in FIG. 1A, a silicon substrate 100 is patterned to form a first penetration hole. The depth of the first penetration hole is about 50 to 500 μm, and the critical dimension (CD), this is, the width, of the first penetration hole is about 1 to 10 μm. Subsequently, a barrier metal 102, such as Ti, TiN, Ti/TiN, Ta, TaN, Ta/TaN, TaN/Ta, Co, Co compound, Ni, Ni compound, W, W compound, or nitride, is deposited on the inner wall of the first penetration hole with a thickness of about 20 to 1000 angstroms using a metal thin-film deposition method, such as a physical vapor deposition (PVD) method, a sputtering method, an evaporation method, a laser ablation method, an atomic layer deposition (ALD) method, or a chemical vapor deposition (CVD) method.

Thereafter, a metal material, such as Al, Al compound, Cu, Cu compound, W or W compound, is buried in the first penetration hole with a thickness of about 50 to 900 μm based on a flat plate using a metal thin-film deposition method, such as a PVD method, a sputtering method, an evaporation method, a laser ablation method, an electro copper plating (ECP) method, an ALD method, or a CVD method, and is planarized using a chemical mechanical polishing (CMP) method or an etch-back method to form a first penetration electrode 104.

As shown in FIG. 1B, an insulating film 106 is deposited on a first surface of silicon substrate 100, in which first penetration electrode 104 is formed, using a CVD apparatus (or a PVD apparatus) and an electric furnace. Insulating film 106 is formed by depositing a dielectric material, such as $SiO_2$, BPSG, TEOS, SiN, or Low-k, with a thickness of about 1 to 10 μm. Thereafter, insulating film 106 is patterned to form an inductor hole and a second penetration hole aligned with the first penetration hole. A barrier metal 120, such as Ti, TiN, Ti/TiN, Ta, TaN, Ta/TaN, TaN/Ta, Co, Co compound, Ni, Ni compound, W, W compound, or nitride, is deposited on the inner walls of the inductor hole and the second penetration hole with a thickness of about 20 to 1000 angstroms using a metal thin-film deposition method, such as a PVD method, a sputtering method, an evaporation method, a laser ablation method, an ALD method, or a CVD method.

Thereafter, a metal material, such as Al, Al compound, Cu, Cu compound, W or W compound, is buried in the inductor hole and the second penetration hole with a thickness of about 2 to 20 μm based on a flat plate using a metal thin-film deposition method, such as a PVD method, a sputtering method, an evaporation method, a laser ablation method, an ECP method, an ALD method, or a CVD method, and is planarized using a CMP method or an etch-back method to form an inductor 110 and a second penetration electrode 108.

As shown in FIG. 1C, a protective film 112, such as $SiO_2$, BPSG, TEOS, or SiN, is deposited on insulating film 106, in which inductor 110 and second penetration electrode 108 are formed, with a thickness of about 0.3 to 5 μm using a CVD method (or a PVD method) and an electric furnace. Thereafter, first penetration electrode 104 is exposed from a second surface of silicon substrate 100, the second surface being opposed to the first surface, by performing a back grind process with respect to silicon substrate 100. At this time, the thickness of silicon substrate 100 becomes about 50 to 500 μm.

As described above, it is possible to simplify the design and the manufacturing process of an RF device and to generate a library of inductors according to the method of manufacturing an inductor using an SIP.

It will be apparent to those skilled in the art that various modifications and variations can be made without departing from the spirit or scope of the invention. Thus, it is intended that the modifications and variations be considered within the scope of the appended claims and their equivalents.

What is claimed is:

1. A method for manufacturing an inductor using a system-in-package (SIP), the method comprising:

forming a penetration hole in a silicon substrate, depositing a first barrier metal in an inner wall of the first penetration hole, entirely filling the first penetration hole with a first metal material, and planarizing the metal material to form a first penetration electrode;

depositing an insulating film on a first surface of the silicon substrate including the first penetration electrode, and patterning the insulating film to form an inductor hole and a second penetration hole aligned with the first penetration hole;

depositing a second barrier metal in inner walls of the inductor hole and the second penetration hole, entirely filling the inductor hole and the second penetration hole with a second metal material, and planarizing the second metal material to form an inductor and a second penetration electrode; and depositing a protective film on the insulating film and performing a back grind process such that the first penetration electrode is exposed from a second surface of the silicon substrate, the second surface being opposed to the first surface.

2. The method according to claim 1, wherein a depth of the first penetration hole is about 50 to 500 μm, and a width of the first penetration hole is about 1 to 10 μm.

3. The method according to claim 1, wherein depositing a first and second barrier metal comprises depositing a metal including at least one of Ti, TiN, Ti/TiN, Ta, TaN, Ta/TaN, TaN/Ta, Co, Co compound, Ni, Ni compound, W, W compound and nitride, and depositing the first and second barrier metal with a thickness of about 20 to 1000 angstroms using any one of metal thin-film deposition methods including a physical vapor deposition (PVD) method, a sputtering method, an evaporation method, a laser ablation method, an atomic layer deposition (ALD) method, and a chemical vapor deposition (CVD) method.

4. The method according to claim 1, wherein:

depositing a first barrier metal comprises:

burying the first metal material including at least one of Al, Al compound, Cu, Cu compound, W or W compound in the first penetration hole with a thickness of about 50 to 900 μm based on a flat plate using any one of metal thin-film deposition methods including a PVD method, a sputtering method, an evaporation method, a laser ablation method, an electro copper plating (ECP) method, an ALD method, and a CVD method; and planarizing the first metal material comprises using a chemical mechanical polishing (CMP) method or an etch-back method to form the first penetration electrode.

5. The method according to claim 1, wherein the insulating film comprises one of $SiO_2$, BPSG, TEOS, SiN, and Low-k, and is formed with a thickness of about 1 to 10 μm using an electric furnace and any one of metal thin-film deposition methods using a CVD apparatus or a PVD apparatus.

6. The method according to claim 1, wherein:

depositing a second barrier metal comprises:

burying the second metal material including one of Al, Al compound, Cu, Cu compound, W or W compound in the inductor hole and the second penetration hole with a thickness of about 2 to 20 μm based on a flat plate using any one of metal thin-film deposition methods including a PVD method, a sputtering method, an evaporation method, a laser ablation method, an ECP method, an ALD method, and a CVD method; and planarizing the metal material using a CMP method or an etch-back method to form the inductor and the second penetration electrode.

* * * * *